US010540831B2

(12) United States Patent
Kwak

(10) Patent No.: US 10,540,831 B2
(45) Date of Patent: Jan. 21, 2020

(54) REAL-TIME ON-BOARD DIAGNOSTICS (OBD) OUTPUT PARAMETER-BASED COMMERCIAL FLEET MAINTENANCE ALERT SYSTEM

(71) Applicant: TrueLite Trace, Inc., Milpitas, CA (US)

(72) Inventor: Sung Bok Kwak, Milpitas, CA (US)

(73) Assignee: Truelite Trace, Inc., San Jose, CA (US)

( * ) Notice: Subject to any disclaimer, the term of this patent is extended or adjusted under 35 U.S.C. 154(b) by 212 days.

(21) Appl. No.: 15/690,218

(22) Filed: Aug. 29, 2017

(65) Prior Publication Data

US 2019/0066407 A1 Feb. 28, 2019

(51) Int. Cl.

| | |
|---|---|
| ***G07C 5/08*** | (2006.01) |
| ***G07C 5/00*** | (2006.01) |
| ***G06Q 50/30*** | (2012.01) |

(52) U.S. Cl.

CPC ..... *G07C 5/0808* (2013.01); *G06Q 50/30* (2013.01); *G07C 5/008* (2013.01)

(58) Field of Classification Search

CPC ..... G07C 5/0808; G07C 5/008; G06Q 50/30
See application file for complete search history.

(56) References Cited

U.S. PATENT DOCUMENTS

| | | | | |
|---|---|---|---|---|
| 7,356,393 | B1 * | 4/2008 | Schlatre | G06Q 10/06 701/29.3 |
| 2005/0060070 | A1 * | 3/2005 | Kapolka | G06Q 10/08 701/31.4 |
| 2016/0035150 | A1 * | 2/2016 | Barfield, Jr. | G07C 5/008 701/29.3 |
| 2016/0110934 | A1 * | 4/2016 | Ernst | G07C 5/085 701/29.6 |
| 2018/0165247 | A1 * | 6/2018 | Flies | G06F 17/00 |

* cited by examiner

*Primary Examiner* — Dale Moyer
(74) *Attorney, Agent, or Firm* — Invent Capture, LLC.; Samuel S. Cho

(57) ABSTRACT

A novel real-time OBD output parameter-based commercial fleet maintenance alert system performs an automated and intelligent analysis of each vehicle's OBD and vehicle sensor output parameters in real time during the operation of the vehicle to determine and alert each fleet vehicle's maintenance needs to an electronic device utilized by a driver or a commercial fleet operator. The commercial fleet maintenance alert system is also capable of performing a machine-level pattern analysis to correlate a previously-alerted maintenance need of a particular vehicle with a subsequent breakdown of the particular vehicle in a commercial fleet to predict a future probability of similar breakdowns by other vehicles in the commercial fleet. In addition, the commercial fleet maintenance alert system is able to generate maintenance status reports and estimate maintenance costs for machine-identified vehicle maintenance needs, which is then compared against actual maintenance costs to improve the accuracy of future cost estimations.

14 Claims, 8 Drawing Sheets

A System Block Diagram of a Real-Time OBD Output Parameter-Based Commercial Fleet Maintenance Alert System

600

A Vehicle Maintenance Monitoring Setting User Interface Screenshot from a Real-Time OBD Output Parameter-Based Commercial Fleet Maintenance Alert System

100

Global Maintenance Setting:

| Global Maintenance Item | | Global Maintenance Cycle |
|---|---|---|
| Oil Change | 3000 | Miles |
| Tire Rotation | 4000 | Miles |
| Wiper Fluid | 3000 | Miles |
| Spark Plugs | 6000 | Miles |
| Transmission | 7000 | Miles |
| Fuel Filter | 8000 | Miles |
| Change Tires | 10000 | Miles |
| ☑ Hourmeter | 1000 | Hour |
| ☑ Daymeter | 90 | Day |

Save

A Vehicle Maintenance Monitoring "Global Setting" (i.e. for all managed commercial fleet vehicles) User Interface Screenshot from a Real-Time OBD Output Parameter-Based Commercial Fleet Maintenance Alert System

200

FIG. 2

| Vehicle | License No | Hourmeter | Daymeter | Odometer(Miles) | Oil Change |
|---|---|---|---|---|---|
| | 7560921698 | N/A | N/A | 0.0 | N/A |
| 2008-BMW-523I | CMV4 - 6GQH... | 1000 | -97 | 11705.9 | 2499 |
| 2009-Toyota-V... | VENZA2009 | 1000 | -105 | 6592.0 | 3000 |
| 2004-Honda-C... | CR-V 5KHT825 | 1000 | -84 | 13840.4 | 2160 |
| 2008-Honda-O... | TLT Demo | 1000 | -41 | 65621.8 | 2998 |
| GL1943-GL1943 | GL1943 | N/A | N/A | 2438.1 | N/A |
| 2006-Isuzu-NPR | 7T44048 | 863 | -73 | 39270.0 | 1899 |
| 2002-Toyota-C... | LA-David | 1000 | -2 | 28343.0 | 3000 |

A Vehicle Maintenance Monitoring Alert User Interface Screenshot that Identifies Maintenance Regulation-Violating Vehicles from a Real-Time OBD Output Parameter-Based Commercial Fleet Maintenance Alert System

300

FIG. 3

| Vehicle | Tire Rotation | Wiper Fluid | Spark Plugs | Transmission | Change Tires | History | Setting |
|---|---|---|---|---|---|---|---|
| | N/A | N/A | N/A | N/A | N/A | | |
| 2008-BMW-523i | 3999 | 2999 | 6294 | 6999 | 16294 | | |
| 2009-Toyota-V... | 4000 | 5000 | -592 | 6808 | 3408 | | |
| 2004-Honda-C... | 4000 | 5000 | 3000 | -6840 | 10000 | | |
| 2008-Honda-O... | 3999 | 4999 | 1259 | 2259 | 5259 | | |
| GL1943-GL1943 | N/A | N/A | N/A | N/A | N/A | | |
| 2006-Isuzu-NPR | -1218 | 1986 | -677 | 323 | 3323 | | |
| 2002-Toyota-C... | 4000 | 5000 | 6000 | 7000 | 10000 | | |

A Vehicle Maintenance Monitoring Alert User Interface Screenshot That Demonstrates Multi-Level Alert Generation for Maintenance Requirement Non-Compliance or for Approaching Maintenance Needs from a Real-Time OBD Output Parameter-Based Commercial Fleet Maintenance Alert System

400

FIG. 4

A Vehicle Maintenance Monitoring Report Export Filter Interface Screenshot That Enables a Machine Generation of a Customized Report Containing Maintenance Requirement Non-Compliance or Imminent Maintenance Needs Based on Real-Time OBD Output Parameter Analysis in a Commercial Fleet Maintenance Alert System

500

A System Block Diagram of a Real-Time OBD Output Parameter-Based Commercial Fleet Maintenance Alert System

600

700

800

REAL-TIME ON-BOARD DIAGNOSTICS (OBD) OUTPUT PARAMETER-BASED COMMERCIAL FLEET MAINTENANCE ALERT SYSTEM

BACKGROUND OF THE INVENTION

The present invention generally relates to vehicle maintenance needs alert and related vehicle information management methods and systems. The present invention also relates to real-time monitoring and data analysis of in-vehicle devices and sensors in a fleet of numerous commercial vehicles from a remote location via wireless communications. Furthermore, the present invention also relates to machine-based automatic determination of correlating patterns between a previously-identified vehicle maintenance need and a subsequent vehicle breakdown.

In commercial transport fleet operations, it is common to accumulate hundreds of thousands of miles in many of the commercially-operated vehicles (e.g. taxis, buses, trucks) annually. The conventional method of tracking of each commercial vehicle's maintenance needs in a typical commercial fleet operation merely involves periodic mechanic checkups and parts and fluid replacements. In many cases, essential or desirable vehicle maintenance and part/fluid replacements are delayed or unperformed due to negligence or incompetence arising from the complexity of tracking maintenance timing and records manually by commercial vehicle drivers and operators.

Furthermore, with conventional vehicle maintenance practice, it is also difficult to identify, track, and respond to vehicle-specific problems and potential parts failures until a particular vehicle suffers an outright mechanical breakdown that results in operational downtime. Conventional computer database systems have been utilized to accommodate manually-set maintenance reminders and to store vehicle maintenance records electronically, but these conventional systems merely track static information manually entered by a human operator, and are unable to provide proactive and intelligent machine sensor-based assessment of dynamically-changing maintenance needs or conditions of individual vehicles in a commercial fleet operation.

Therefore, it may be desirable to devise a novel commercial fleet maintenance alert system that performs automated and intelligent analysis of each vehicle's OBD and other sensor output parameters in real time from a remote monitoring station to determine and alert each fleet vehicle's maintenance needs to a driver or a commercial fleet operator.

Furthermore, it may also be desirable to devise a novel commercial fleet maintenance alert system that provides a machine-level pattern analysis that correlates a previously-alerted maintenance need of a particular vehicle with a subsequent breakdown of the particular vehicle in a commercial fleet to predict a future probability of similar breakdowns by other vehicles in the commercial fleet.

In addition, it may also be desirable to devise a method of operating such novel commercial fleet maintenance alert systems for commercial vehicle operation managers and commercial vehicle drivers.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a commercial fleet maintenance alert system is disclosed. This system comprises: a vehicle on-board diagnostics (OBD) device connected to an engine control unit or a vehicular control chipset of a vehicle to record, diagnose, and generate engine, vehicle dynamics, and vehicle parts operations data as streams of vehicle on-board diagnostics (OBD) data output;

a maintenance needs analytics module that analyzes the streams of vehicle OBD data output and maintenance threshold settings parameters to determine a vehicle maintenance need for a maintenance alert generation and to derive a quantitative correlation between the vehicle maintenance need identified by the maintenance needs analytics module and a future breakdown of the vehicle, wherein the quantitative correlation is an output of a vehicle breakdown pattern analysis module incorporated in the commercial fleet maintenance alert system;

a commercial fleet maintenance needs alert and report generation system comprising a commercial fleet maintenance needs alert module configured to generate a maintenance needs alert based on the vehicle maintenance need identified by the maintenance needs analytics module, and a commercial fleet maintenance report module configured to generate a report containing a maintenance requirement non-compliance item or an urgent maintenance need, wherein the maintenance needs alert and the report are transmitted to an electronic device utilized by a vehicle driver or by a system operator; and a semiconductor chip or a hardware device that contains at least one of the maintenance needs analytics module and the commercial fleet maintenance needs alert and report generation system.

BRIEF DESCRIPTION OF DRAWINGS

FIG. 2 shows a vehicle maintenance monitoring "Global Setting" user interface screenshot from a real-time OBD output parameter-based commercial fleet maintenance alert system, in accordance with an embodiment of the invention.

FIG. 3 shows a vehicle maintenance monitoring alert user interface screenshot that identifies maintenance regulation-violating vehicles from a real-time OBD output parameter-based commercial fleet maintenance alert system, in accordance with an embodiment of the invention.

FIG. 4 shows a vehicle maintenance monitoring alert user interface screenshot that demonstrates multi-level alert generation for maintenance requirement non-compliance or for approaching maintenance needs from a real-time OBD output parameter-based commercial fleet maintenance alert system, in accordance with an embodiment of the invention.

DETAILED DESCRIPTION

Figure 1:
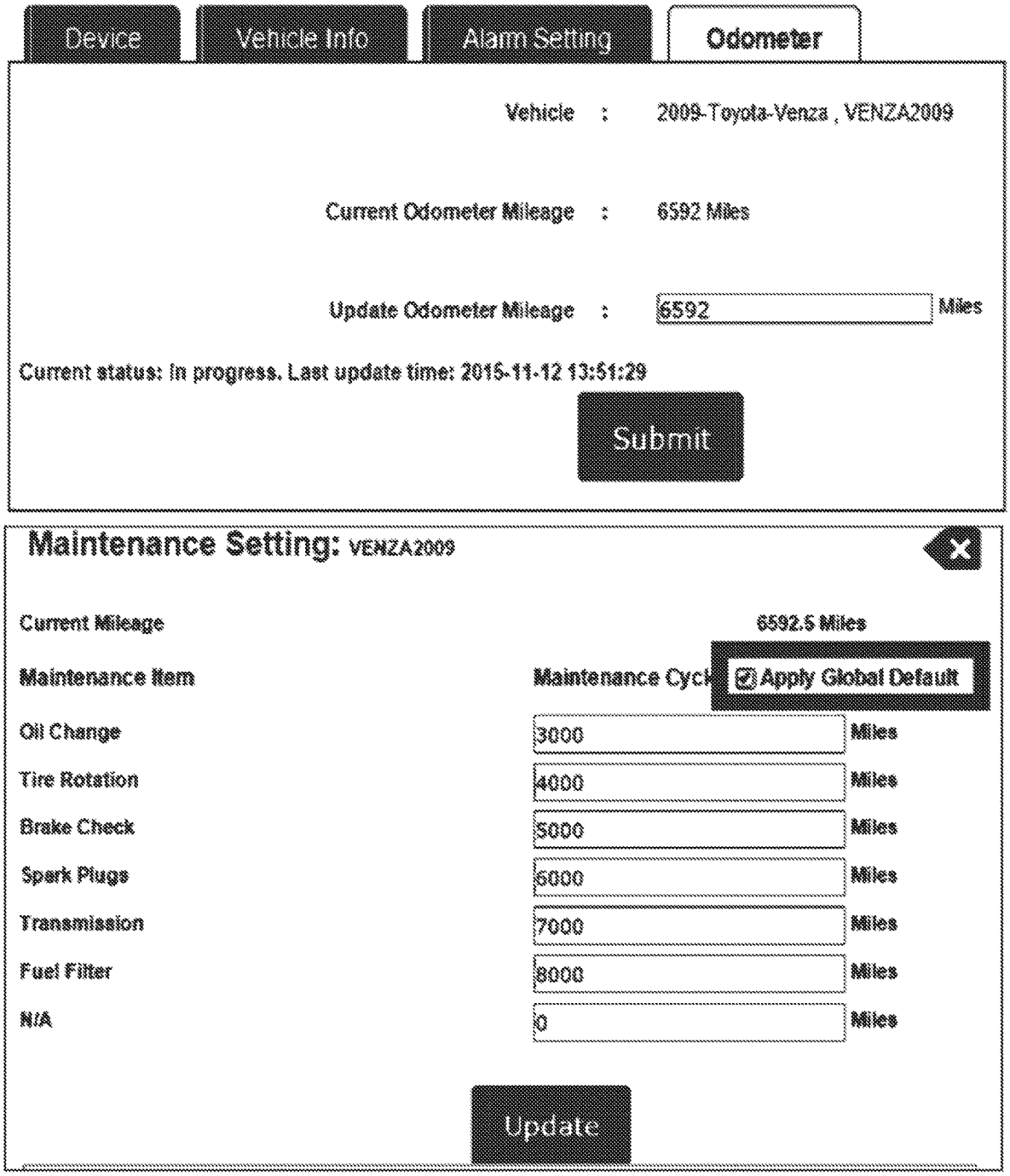
FIG. 1 shows a vehicle maintenance monitoring setting user interface screenshot from a real-time on-board diagnostics (OBD) output parameter-based commercial fleet maintenance alert system, in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble one or more real-time OBD output parameter-based commercial fleet maintenance alert systems or methods of operating such novel systems. These descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention For the purpose of describing the invention, a term, "on-board diagnostics (OBD) device," is defined as an electronic device installed in a vehicle to collect and/or analyze a variety of vehicle-related data. In one example, a vehicle's onboard computer outputs many data parameters to the OBD device in real-time, such as vehicle diagnostic information (e.g. engine temperature, air flow sensor outputs, engine oil level, transmission oil status, OBD fault codes, and etc.), engine operating cumulative hours, speed information, engine rotation-per-minute (RPM) information, fuel levels, and miles driven relative to time. These data parameter output steams can be part of the vehicle-related data collected and analyzed by a vehicle-side maintenance needs analytics module and/or a server-side commercial fleet maintenance needs analytics module.

In addition, for the purpose of describing the invention, a term, "maintenance need," is defined as an electronic system-determined action item that requires a vehicle operator's attention for inspection, repair, and/or replacement of vehicle parts or fluids. For example, if a real-time OBD output parameter-based commercial fleet maintenance alert system, in accordance with an embodiment of the present invention, determines that there is a maintenance need for a particular vehicle within a group of commercial fleet vehicles, the commercial fleet maintenance alert system may transmit a dynamically-generated "maintenance need" alert as an email, a text message, a chat message, or a machine-initiated phone call with an interactive voice response (IVR) to a personal computer, a smart phone, or another electronic device readily accessible by a corresponding vehicle driver, a fleet vehicle operations manager, and/or a fleet vehicle operations mechanic.

Moreover, for the purpose of describing the invention, a term, "vehicle breakdown," is defined as a mechanical and/or electronic malfunction of a vehicle that renders driving or operation of the vehicle unsafe, inoperable, illegal, or undesirable. A vehicle breakdown typically exceeds the state of maintenance need alerts, as the vehicle is already at a more severe stage of inoperability, regulatory violations, and/or compromised safety.

Furthermore, for the purpose of describing the invention, a term, "day-meter," is defined as a vehicle maintenance interval measured by a number of elapsed days since initiating a "reset" day by a real-time OBD output parameter-based commercial fleet maintenance alert system operator. The day-meter may be particularly useful in states or municipalities that impose mandatory vehicle inspection and maintenance regulations to commercial vehicles in specified calendar day cycles. For example, a state or a municipal authority may require a commercial vehicle to be inspected and maintained by a mechanic every ninety days. The day-meter, if configured and utilized by the real-time OBD output parameter-based commercial fleet maintenance alert system, enables a commercial vehicle driver and a system operator to be reminded of the number of days remaining or past relative to the next mandatory vehicle maintenance date imposed by regulatory authorities or by the commercial fleet management. In one example, if the day-meter is set to 90 days, the number of days remaining (i.e. since the last day-meter reset) until the next mandatory vehicle maintenance date is shown as a positive number. If the number of days remaining since the last day-meter reset is already past the next mandatory vehicle maintenance date, then the number of violation days accumulated after the maintenance due date is shown as a negative number.

In addition, for the purpose of describing the invention, a term, "hour-meter," is defined as a vehicle maintenance interval measured by a number of elapsed vehicle operating hours since initiating a "reset" hour by a real-time OBD output parameter-based commercial fleet maintenance alert system operator. The hour-meter may be particularly useful for understanding and tracking the number of operating hours for automotive parts or fluids since the last vehicle maintenance. For example, vehicle engine operating hours can be correlated to automotive manufacturer-recommended guidelines for replacing certain consumable parts, such as spark plugs, coolant fluids, air filters, and battery packs. In some cases, the hour-meter measurement enables a real-time OBD output parameter-based commercial fleet maintenance alert system to analyze and determine parts and fluid replacement timing based on the number of operating hours since the last part replacement or inspection.

Furthermore, for the purpose of describing the invention, a term, "maintenance needs analytics module," is defined as an electronic sub-system, which comprises at least one of a vehicle-specific maintenance needs identification and analytics unit, an OBD data transceiver unit, a commercial fleet-level maintenance needs identification and analytics unit, and a commercial fleet maintenance database. In a preferred embodiment of the invention, this electronic subsystem may also incorporate a data communication unit, a memory unit, and a central processing unit (CPU) as one or more special-purpose electronic hardware installed at least partly in a vehicle and a commercial fleet remote monitoring station.

Moreover, for the purpose of describing the invention, a term, "commercial fleet remote monitoring station," is defined as a vehicle fleet monitoring location for one or more commercial vehicles in operation. Examples of commercial fleet remote monitoring station units include, but are not limited to, a commercial vehicle operation control center, a vehicle monitoring service center, and a fleet vehicle employer's information technology (IT) control center.

In addition, for the purpose of describing the invention, a term, "computer server," is defined as a physical computer system, another hardware device, a software and/or hardware module executed in an electronic device, or a combination thereof. For example, in context of an embodiment of the invention, a "computer server" is dedicated to executing one or more computer programs for receiving, processing, and analyzing vehicle maintenance needs-related OBD input data, and generating, calculating, displaying, and/or transmitting vehicle maintenance needs alerts and periodic maintenance item reports based on maintenance threshold values on various vehicle parts and fluids, regulatory guidelines, and commercial fleet-specific rules and policies that are holistically and autonomously analyzed by a commercial fleet maintenance alert system. Furthermore, in one embodiment of the invention, a computer server is connected to one or more data networks, such as a local area network (LAN), a wide area network (WAN), a cellular network, and the Internet.

One aspect of an embodiment of the present invention is providing a novel commercial fleet maintenance alert system that performs automated and intelligent analysis of each vehicle's OBD and other sensor output parameters in real time from a remote monitoring station to determine and alert each fleet vehicle's maintenance needs to a driver or a commercial fleet operator.

Another aspect of an embodiment of the present invention is providing a novel commercial fleet maintenance alert system that performs a machine-level pattern analysis to correlate a previously-alerted maintenance need of a particular vehicle with a subsequent breakdown of the particular vehicle in a commercial fleet to predict a future probability of similar breakdowns by other vehicles in the commercial fleet.

Yet another aspect of an embodiment of the present invention is providing a novel commercial fleet maintenance alert system that estimates approximate maintenance costs for machine-identified vehicle maintenance needs and compares against actual maintenance costs incurred subsequently to improve the accuracy of the cost estimations generated by the novel commercial fleet maintenance alert system.

Yet another aspect of an embodiment of the invention is providing a method of operating such novel commercial fleet maintenance alert systems for commercial vehicle operation managers and commercial vehicle drivers.

FIG. 1 shows a vehicle maintenance monitoring setting user interface screenshot (100) from a real-time on-board diagnostics (OBD) output parameter-based commercial fleet maintenance alert system, in accordance with an embodiment of the invention. As shown in this screen shot, the real-time on-board diagnostics (OBD) output parameter-based commercial fleet maintenance alert system is configured to generate a vehicle maintenance monitoring setting user interface that enables a vehicle driver or a commercial fleet management personnel to define, set, and adjust maintenance cycles for parts, fluids, or desirable routine services.

For example, as shown by the vehicle maintenance monitoring setting user interface screenshot (100), for a vehicle described as "VENZA2009," maintenance action items such as oil change, tire rotation, and brake check are each assigned with a specific number of miles (e.g. 3000 miles, 4000 miles, 5000 miles, etc.) as a threshold for the next maintenance need alert generation for each specified item by the real-time on-board diagnostics (OBD) output parameter-based commercial fleet maintenance alert system.

Likewise, specific consumable parts such as spark plugs and fuel filters are also each assigned with a specific number of miles (e.g. 6000 miles, 8000 miles, etc.) as a threshold for parts replacement and maintenance alert generation for each specified part by the real-time on-board diagnostics (OBD) output parameter-based commercial fleet maintenance alert system. These maintenance settings adjusted by the vehicle driver or the commercial fleet management personnel may be applied to a particular vehicle (e.g. "VENZA2009"), or applied to an entire commercial vehicle fleet, if the "global default" setting is enabled, as shown in FIG. 1. Moreover, in one embodiment of the invention, the maintenance settings for the real-time on-board diagnostics (OBD) output parameter-based commercial fleet maintenance alert system may be autonomously and intelligently determined by the system's artificial intelligence that gathers vehicle manufacturers' recommended maintenance, part replacement schedules, and regulatory policy guidelines from a computerized data network, even without human operator interventions and/or data entries.

Furthermore, as also shown in FIG. 1, the vehicle maintenance monitoring setting user interface also enables the vehicle driver or the commercial fleet management personnel to adjust certain vehicle data parameters (e.g. odometer readings, maintenance alarm settings, vehicle-identifying information, communication device information, etc.) manually via computerized menu tabs and buttons. In the example as shown in FIG. 1, although the odometer readings for a particular vehicle selected (e.g. "2009-Toyota-Venza, VENZA2009") may be automatically streamed from a vehicle OBD device as part of OBD output parameters, human operator-based manual adjustments may sometimes be desirable if the current odometer information is at least temporarily outdated, or if there is a communication error between the vehicle OBD device and a maintenance needs analytics module in the real-time on-board diagnostics (OBD) output parameter-based commercial fleet maintenance alert system.

FIG. 2 shows a vehicle maintenance monitoring "Global Setting" user interface screenshot (200) from a real-time OBD output parameter-based commercial fleet maintenance alert system, in accordance with an embodiment of the invention. The global maintenance setting, as shown in the vehicle maintenance monitoring "Global Setting" user interface screenshot (200), is configured to define maintenance (i.e. inspection or part replacement) cycles across the board among a plurality of commercial vehicles that are assigned in a commercial fleet. For example, the global maintenance cycles for oil changes, tire rotations, wiper fluid changes, and spark plug inspections may define a universal maintenance alert policy among all trucks utilized in transportation of beverages in the commercial fleet.

Furthermore, as shown in the vehicle maintenance monitoring "Global Setting" user interface screenshot (200), the real-time on-board diagnostics (OBD) output parameter-based commercial fleet maintenance alert system enables a driver or a system operator to adjust an "hour-meter" and a "day-meter" for defining a customized maintenance interval that indicates the elapsed time measured in vehicle operating hours or in calendar days since the timing of the last maintenance checkup, repairs, or part replacements. The hour-meter and the day-meter may be set globally for all vehicles or individually for each vehicle in a commercial fleet. Examples of such commercially-operated vehicles are buses, trucks, taxis, boats, or other commercially-utilized automobiles or vessels. Alternatively, the hour-meter and the day-meter may be manually reset by the driver or the system operator at a preferred starting point for measuring the number of vehicle operating hours or calendar days since initiating the reset.

FIG. 3 shows a vehicle maintenance monitoring alert user interface screenshot (300) that identifies maintenance regulation-violating vehicles from a real-time OBD output parameter-based commercial fleet maintenance alert system, in accordance with an embodiment of the invention. As shown by this user interface screenshot (300), a vehicle identifier, a corresponding license plate number, an hour-meter reading, a day-meter reading, an odometer reading, and a remaining miles left until the next required oil change are displayed in the vehicle maintenance monitoring alert user interface and are managed by the real-time OBD output parameter-based commercial fleet maintenance alert system.

Furthermore, as shown in this screenshot (300), six vehicles displayed on the vehicle maintenance monitoring alert user interface have negative day-meter values (i.e. encapsulated in segmented rectangles for illustration purposes in FIG. 3), which indicate maintenance timing overdue violations since the last reset of the day-meter indicators for each displayed vehicle. In a preferred embodiment of the invention, the day-meter can display maintenance timing overdue violations by various color-coding schemes. For example, a day-meter indicator that displays an approaching maintenance due date may display the day-meter metric in yellow, while displaying an overdue day-meter violation past the maintenance due date in orange or red, depending on the severity of the overdue status.

In a preferred embodiment of the invention, a day-meter is defined as a vehicle maintenance interval measured by a number of elapsed days since initiating a "reset" day by a real-time OBD output parameter-based commercial fleet maintenance alert system operator. The day-meter may be particularly useful in states or municipalities that impose mandatory vehicle inspection and maintenance regulations to commercial vehicles in specified calendar day cycles. For example, a state or a municipal authority may require a commercial vehicle to be inspected and maintained by a mechanic every ninety days. The day-meter, if configured and utilized by the real-time OBD output parameter-based commercial fleet maintenance alert system, enables a commercial vehicle driver and a system operator to be reminded of the number of days remaining or past relative to the next mandatory vehicle maintenance date imposed by regulatory authorities or by the commercial fleet management.

In one example, if the day-meter is set to 90 days, the number of days remaining (i.e. since the last day-meter reset) until the next mandatory vehicle maintenance date is shown as a positive number. If the number of days remaining since the last day-meter reset is already past the next mandatory vehicle maintenance date, then the number of violation days accumulated after the maintenance due date is shown as a negative number. In context of the vehicle maintenance monitoring alert user interface screenshot (300) in FIG. 3, six vehicles are flagged as violating day-meter-based regular maintenance and inspection requirement that had been configured in the commercial fleet maintenance alert system.

FIG. 4 shows a vehicle maintenance monitoring alert user interface screenshot (400) that demonstrates multi-level alert generation for maintenance requirement non-compliance or for approaching maintenance needs from a real-time OBD output parameter-based commercial fleet maintenance alert system, in accordance with an embodiment of the invention. As shown by this user interface screenshot (400), a vehicle identifier, a tire rotation remaining interval indicator, a wiper fluid remaining interval indicator, a spark plug check remaining interval indicator, a transmission check remaining interval indicator, a tire replacement remaining interval indicator, and a vehicle maintenance history file are displayed as instances of maintenance monitoring items from the real-time OBD output parameter-based commercial fleet maintenance alert system.

Furthermore, as shown in this screenshot (400), five items (i.e. illustrated in segmented rectangles in FIG. 4) from three vehicles are determined by the commercial fleet maintenance alert system to be requiring an operator's attention for immediate maintenance work. Negative numbers from maintenance item indicators typically symbolize an extent of overdue maintenance work. For example, the "2006-Isuzu-NPR" vehicle, as shown in FIG. 4, is subject to a tire rotation that is overdue from a desirable or required maintenance timing by 1216 miles, which is indicated as a negative number. Likewise, the same vehicle also has a spark plug maintenance check that is overdue from the desirable or required maintenance timing by 677 miles, which is also represented as a negative number. On the other hand, the same vehicle has a desired or required transmission inspection check timing in the next 323 miles of operation, which is why the transmission check remaining interval indicator is still represented as a positive number.

In a preferred embodiment of the invention, the vehicle maintenance monitoring alert user interface can display maintenance timing overdue violations by various color-coding schemes. For example, maintenance item indicators for the tire rotation interval, the wiper fluid change interval, the spark plug check interval, the transmission check interval, and the tire replacement interval may display an imminent maintenance check item in yellow if the maintenance is not yet overdue, while displaying overdue maintenance items in different warning colors, such as orange or red, depending on the severity of the overdue status.

Figure 5:
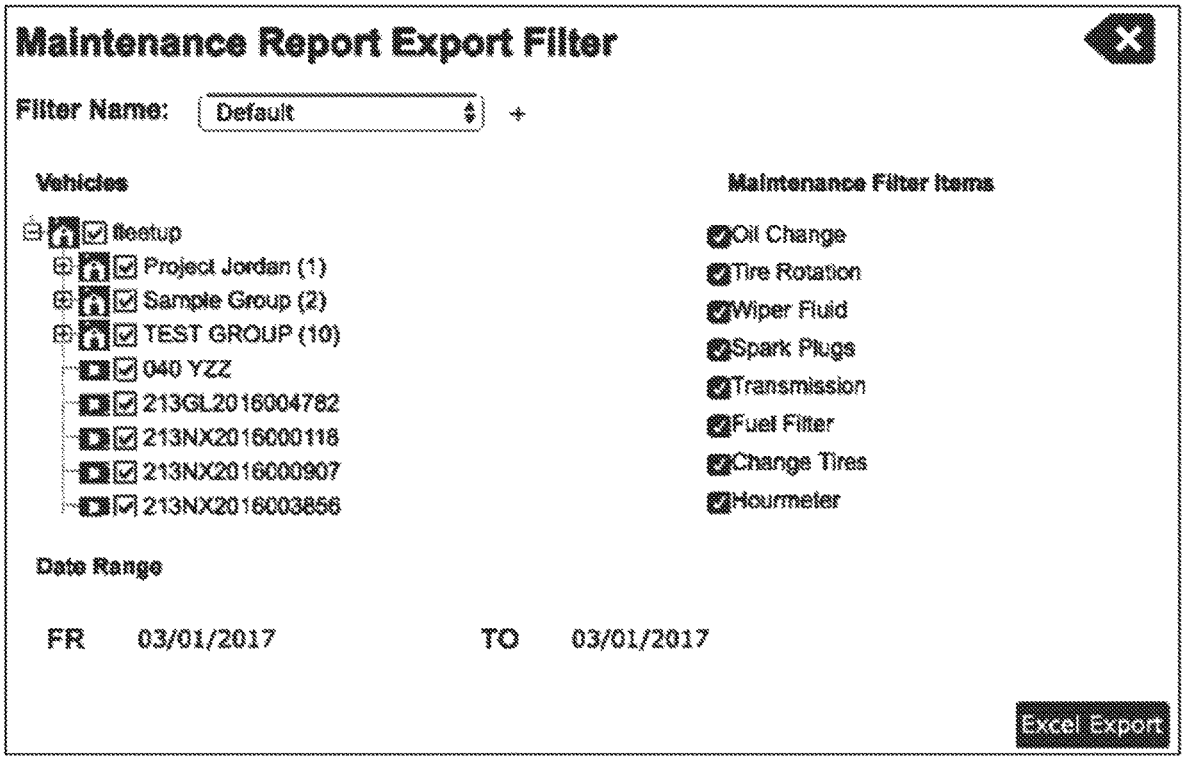
FIG. 5 shows a vehicle maintenance monitoring report export filter interface screenshot that enables a machine generation of a customized report containing maintenance requirement non-compliance or approaching maintenance needs based on real-time OBD output parameter analysis in a commercial fleet maintenance alert system, in accordance with an embodiment of the invention.

FIG. 5 shows a vehicle maintenance monitoring report export filter interface screenshot (500) that enables a machine generation of a customized report containing maintenance requirement non-compliance or imminent maintenance needs based on real-time OBD output parameter analysis in a commercial fleet maintenance alert system, in accordance with an embodiment of the invention. As shown by the vehicle maintenance monitoring report export filter interface screenshot (500), the commercial fleet maintenance alert system in accordance with an embodiment of the present invention is able to produce a machine-generated maintenance report for a particular vehicle in a commercial fleet or for a plurality of selected vehicles in the commercial fleet. As shown in FIG. 5, the maintenance report may be exported to a Microsoft Excel worksheet or another computer program that can place the maintenance report in its native file format.

Specific maintenance action items, such as oil change, tire rotation, wiper fluid refill, spark plug checkup, and transmission inspection, can be incorporated into the machine-generated maintenance report and transmitted to an electronic device accessed by a fleet operations management, a vehicle driver, or another responsible personnel in the commercial fleet operation. The machine-generated maintenance report may be periodic (e.g. daily, weekly, monthly, quarterly, etc.) or dynamically-triggered by an urgent maintenance checkup need in one or more commercial vehicles in the commercial fleet operation. Furthermore, in one embodiment of the invention, the commercial fleet maintenance alert system executes machine-learning as part of its artificial intelligence to create a maintenance report for the commercial fleet operators, wherein the machine-learning involves the commercial fleet maintenance alert system autonomously (i.e. without a human intervention) analyzing and finding tendencies and patterns from real-time data streams produced by in-vehicle chipsets, in-vehicle sensors, and vehicle maintenance guidelines and rules provided by an auto manufacturer or a mechanic. In another embodiment of the invention, the vehicle maintenance monitoring report export filter interface serves as a computerized tool for a human operator who is attempting to package a maintenance report for an auto mechanic, a commercial vehicle driver, and/or a vehicle operations management personnel.

Figure 6:
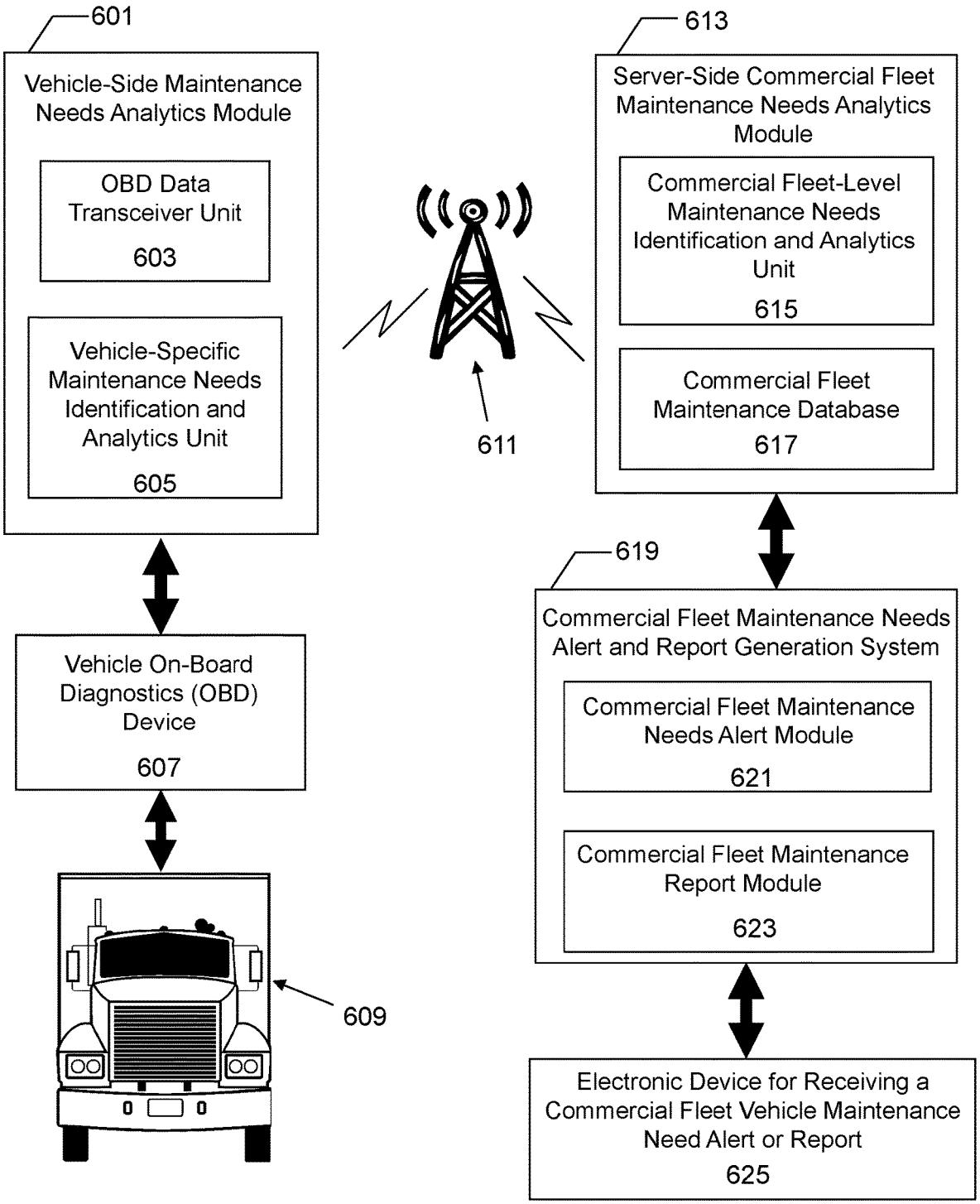
FIG. 6 shows a system block diagram of a real-time OBD output parameter-based commercial fleet maintenance alert system, in accordance with an embodiment of the invention.

FIG. 6 shows a system block diagram (600) of a real-time OBD output parameter-based commercial fleet maintenance alert system, in accordance with an embodiment of the invention. As shown by the system block diagram (600), the real-time OBD output parameter-based commercial fleet maintenance alert system comprises a vehicle-side maintenance needs analytics module (601), a vehicle on-board diagnostics (OBD) device (607), a data communication network (611), a server-side commercial fleet maintenance needs analytics module (613), a commercial fleet maintenance needs alert and report generation system (619), and optionally, a commercial fleet remote monitoring station. The real-time OBD output parameter-based commercial fleet maintenance alert system is also operatively connected to a vehicle driver's or a system operator's electronic device (625) that receives a commercial fleet vehicle maintenance need alert or report, as shown in FIG. 6. The vehicle driver's or the system operator's electronic device may be a cellular phone, a notebook computer, a tablet computer, a display unit connected to a computer server, or another electronic device.

In this embodiment of the invention, the vehicle-side maintenance needs analytics module (601) includes an OBD data transceiver unit (603) and a vehicle-specific maintenance needs identification and analytics unit (605). Furthermore, the server-side commercial fleet maintenance needs analytics module (613) includes a commercial fleet-level maintenance needs identification and analytics unit (615) and a commercial fleet maintenance database (617), as shown in FIG. 6. Moreover, the data communication network (611) may include at least one of a cellular communication network, a satellite communication network, a land-mobile radio communication network, or a combination thereof.

In the embodiment of the invention as shown in FIG. 6, the vehicle OBD device (607) is installed inside a vehicle (609), such as a truck, a van, a taxi, or another vehicle. The vehicle OBD device (607) is also typically connected to an engine control unit and other vehicular control chipsets to record, diagnose, and generate a variety of engine, vehicle dynamics, and parts operation functionality data output parameters as a real-time data stream. This real-time data stream from the vehicle OBD device (607) can be transmitted locally inside the vehicle (609) to the vehicle-side maintenance needs analytics module (601), which in turn analyzes the real-time data stream to relay, analyze, and/or determine vehicle-specific maintenance needs, such as oil change, brake pads replacement, spark plug check, transmission check, and etc.

Furthermore, in the embodiment of the invention as shown in FIG. 6, various engine, vehicle dynamics, and parts operation functionality data output parameters from the vehicle OBD device (607) are transmitted to the server-side commercial fleet maintenance needs analytics module (613), and are categorized and stored in the commercial fleet maintenance database (617) for subsequent analysis and determination of individual vehicle maintenance needs and fleet-wide "global" maintenance needs. The commercial fleet maintenance database (617) can store, update, and categorize incoming data from the vehicle OBD device (607) by vehicle models, makes and fleet group types (e.g. trucks, vans, taxis, buses, etc.), wherein the commercial fleet maintenance database (617) is typically operated and executed by a computer server located in the commercial fleet remote monitoring station. Moreover, the commercial fleet maintenance database (617) may also store, update, and categorize vehicle parts operating functionality, vehicle dynamics and vehicle maintenance records by driving routes and traffic conditions.

Continuing with the embodiment of the invention as shown in FIG. 6, the vehicle-side maintenance needs analytics module (601) may request and receive a relevant portion of the vehicle maintenance records from the commercial fleet maintenance database (617) through the data communication network (611), in order to determine a potential new maintenance need in the vehicle (609). In another embodiment of the invention, a vehicle-specific maintenance need or a fleet-wide maintenance need may be analyzed and determined entirely by the server-side commercial fleet maintenance needs analytics module (613) after the real-time data stream from the vehicle OBD device (607) is wirelessly transmitted to the server-side commercial fleet maintenance needs analytics module (613) via the OBD data transceiver unit (603) and the data communication network (611).

If the commercial fleet-level maintenance needs identification and analytics unit (615) is performing all of the analysis associated with determining a vehicle-specific and/or fleet-wide vehicle maintenance need, then it may be unnecessary to implement the vehicle-specific maintenance needs identification and analytics unit (605) in such instances. Yet in another embodiment of the invention, some of the vehicle-specific and/or fleet-wide vehicle maintenance need analysis is performed inside the vehicle (609) by the vehicle-side maintenance needs analytics module (601), while some other portions of the vehicle-specific and/or fleet-wide vehicle maintenance need analysis are performed by the server-side commercial fleet maintenance needs analytics module (613). In such instances, the separate analysis and the computations from the vehicle-side maintenance needs analytics module (601) and the server-side commercial fleet maintenance needs analytics module (613) may be combined or shared through the data communication network (611).

Moreover, in the preferred embodiment of the invention, vehicle-specific or fleet-wide maintenance needs analysis performed by the vehicle-side maintenance needs analytics module (601) and the server-side commercial fleet maintenance needs analytics module (613) is transmitted to the commercial fleet maintenance needs alert and report generation system (619) to synthesize and generate a maintenance needs alert or a maintenance report. As shown in FIG. 6, a commercial fleet maintenance needs alert module (621) in the commercial fleet maintenance needs alert and report generation system (619) is configured to generate the maintenance needs alert based on a maintenance need identified by the vehicle-side maintenance needs analytics module (601) and/or the server-side commercial fleet maintenance needs analytics module (613). The maintenance alert may be in form of a text message, a chat message, an email, or a computer-generated voice call that contains a vehicle maintenance action. The maintenance alert is typically transmitted to an electronic device (e.g. 625) utilized and accessed by a vehicle driver or a system operator.

Similarly, a commercial fleet maintenance report module (623) in the commercial fleet maintenance needs alert and report generation system (619) is configured to generate the maintenance report based on a maintenance need identified by the vehicle-side maintenance needs analytics module (601) and/or the server-side commercial fleet maintenance needs analytics module (613). The maintenance report may be in a document file format (e.g. MS Word, PDF, Excel, etc.) and can be transmitted to the vehicle driver's or the system operator's electronic device as a file attachment or as an online-accessible document. The issuance of the maintenance report by the commercial fleet maintenance report module (623) may be periodic (e.g. daily, weekly, monthly, etc.) or dynamic event-triggered, wherein the event may be an urgent maintenance inspection item newly identified by the vehicle-side maintenance needs analytics module (601) and/or the server-side commercial fleet maintenance needs analytics module (613).

Furthermore, the commercial fleet remote monitoring station is a vehicle fleet monitoring location for one or more vehicles in operation. In the preferred embodiment of the invention, the commercial fleet remote monitoring station may be a commercial vehicle operation control center, a vehicle monitoring service center, or a fleet vehicle employer's information technology (IT) control center that also houses a computer server for executing and operating the server-side commercial fleet maintenance needs analytics module (613) and the commercial fleet maintenance needs alert and report generation system (619). For a seamless operation of the real-time OBD output parameter-based commercial fleet maintenance alert system, a monitoring station personnel in the commercial fleet remote monitoring station may access, view, and/or control various threshold levels, maintenance intervals, and cycles for vehicle-specific or fleet-wide vehicle maintenance needs alerts and reports.

Figure 7:
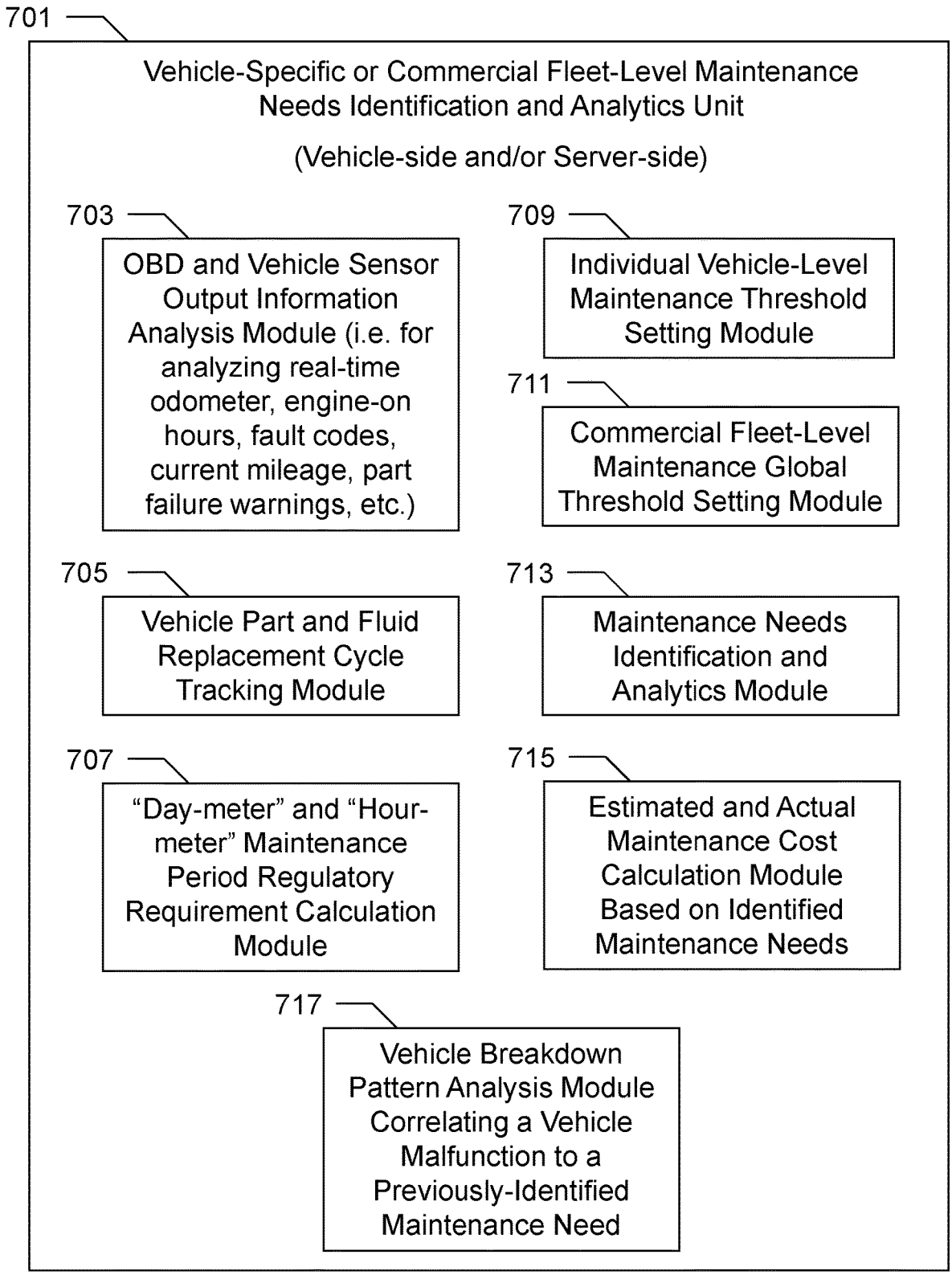
FIG. 7 shows a vehicle-specific or commercial fleet-level maintenance needs identification and analytics unit, in accordance with an embodiment of the invention.

FIG. 7 shows a system block diagram (700) of a vehicle-specific or commercial fleet-level maintenance needs identification and analytics unit (701), in accordance with an embodiment of the invention. In a preferred embodiment of the invention, the vehicle-specific or commercial fleet-level maintenance needs identification and analytics unit (701) can be an embedded block diagram of the vehicle-specific maintenance needs identification and analytics unit (605) and/or the commercial fleet-level maintenance needs identification and analytics unit (615) that have been previously described and illustrated in FIG. 6.

In this embodiment, an OBD and vehicle sensor output information analysis module (703) receives an OBD data stream from a vehicle OBD device (e.g. 607 of FIG. 36), and keeps track of various data parameters such as vehicle identification numbers, engine operating hours, part malfunction/fault codes, engine RPM, acceleration, speed, and fuel consumption data. The OBD and vehicle sensor output information analysis module (703) is configured to determine any data anomaly or malfunction indicators, and share its analysis with other modules. For example, a maintenance needs identification and analytics module (713), which also receives vehicle-specific and fleet-wide maintenance need information from a vehicle part and fluid replacement cycle tracking module (705) and a day-meter and hour-meter maintenance period regulatory requirement calculation module (707), is designed to make a holistic determination of a vehicle-specific or fleet-wide maintenance need based on the OBD data stream analysis from the OBD and vehicle sensor output information analysis module (703) and other analytical modules (i.e. 705, 707).

In particular, the vehicle part and fluid replacement cycle tracking module (705) is configured to receive part or fluid container status information from an in-vehicle chipset and subsequently determine a vehicle maintenance need based on the part or fluid container status information. For example, a windshield washer fluid container may have a sensor that indicates whether the container is nearly empty. If the sensor detects near-depletion of windshield washer fluid, then that information is ultimately transmitted to the vehicle part and fluid replacement cycle tracking module (705) in the maintenance needs identification and analytics unit (701). The vehicle part and fluid replacement cycle tracking module (705) then determines that there is a need for windshield washer fluid replenishment, and transmits its analysis to the maintenance needs identification and analytics module (713), which makes a holistic and final decision after inspecting other parameters, variables, and information from other analytical modules (i.e. 703, 707). Once a decision to generate a maintenance alert or a maintenance report is made from the maintenance needs identification and analytics module (713), the commercial fleet maintenance needs alert and report generation system (619) receives a command from the maintenance needs identification and analytics module (713) and synthesizes the maintenance alert or the maintenance report, as described previously.

Furthermore, in the embodiment of the invention as shown in FIG. 7, the day-meter and hour-meter maintenance period regulatory requirement calculation module (707) is configured to calculate and track current counters for a day-meter and an hour-meter. Typically, a user is able to initiate or reset the day-meter and/or the hour-meter via a vehicle maintenance monitoring setting user interface, which is provided by an individual vehicle-level maintenance threshold setting module (709) and/or a commercial fleet-level maintenance global threshold setting module (711). If the current counter for the day-meter or the hour-meter is approaching or exceeding a maintenance alert threshold value (e.g. a 90-day maintenance counter for the day-meter, 1000 hour counter for measuring an active engine operation by the hour-meter, etc.), then the day-meter and hour-meter maintenance period regulatory requirement calculation module (707) informs the maintenance needs identification and analytics module (713) that there is a potential need to generate a maintenance alert for a day-meter or an hour-meter violation.

The maintenance needs identification and analytics module (713) then makes a holistic and final decision after inspecting other parameters, variables, and information from other analytical modules (i.e. 703, 705). Once a decision to generate a maintenance alert or a maintenance report is made from the maintenance needs identification and analytics module (713) for potential hour-meter or day-meter violation(s) by one or more specified vehicles in a commercial fleet, the commercial fleet maintenance needs alert and report generation system (619) receives a command from the maintenance needs identification and analytics module (713) and synthesizes the maintenance alert or the maintenance report, as described previously.

Moreover, the vehicle-specific or commercial fleet-level maintenance needs identification and analytics unit (701) may also incorporate an estimated and actual maintenance cost calculation module (715) that makes an initial maintenance cost estimate based on known cost-related information, and further refines the initial maintenance cost modeling for future iterations of estimates by comparing and adjusting the initial maintenance cost estimate to an actual cost incurred by a user. Furthermore, the vehicle-specific or commercial fleet-level maintenance needs identification and analytics unit (701) may also include a vehicle breakdown pattern analysis module (717), which is configured to correlate an actual malfunction/breakdown of a vehicle to a previously-identified maintenance need by the vehicle-specific or commercial fleet-level maintenance needs identification and analytics unit (701). The correlation may be statistically expressed in terms of an odds ratio or a risk ratio computed by the vehicle breakdown pattern analysis module (717). Furthermore, a frequency of OBD fault code events and/or maintenance alert events may further be correlated to an actual vehicle breakdown in search of identifying a reliable causal effect.

In one embodiment of the invention, various modules in the vehicle-specific or commercial fleet-level maintenance needs identification and analytics unit (701), as shown in FIG. 7, may be implemented as on-chip modules, hardware modules, software modules executed in a CPU or a memory unit of a computer server, or as a special-purpose electronic system for commercial fleet vehicle maintenance alerts and reports. In another embodiment of the invention, various modules in the vehicle-specific or commercial fleet-level maintenance needs identification and analytics unit (701), as shown in FIG. 7, may be implemented in one or more semiconductor chips. Yet in another embodiment of the invention, various modules in the vehicle-specific or commercial fleet-level maintenance needs identification and analytics unit (701), as shown in FIG. 7, may be implemented as a combination of software modules and one or more semiconductor chips.

Figure 8:
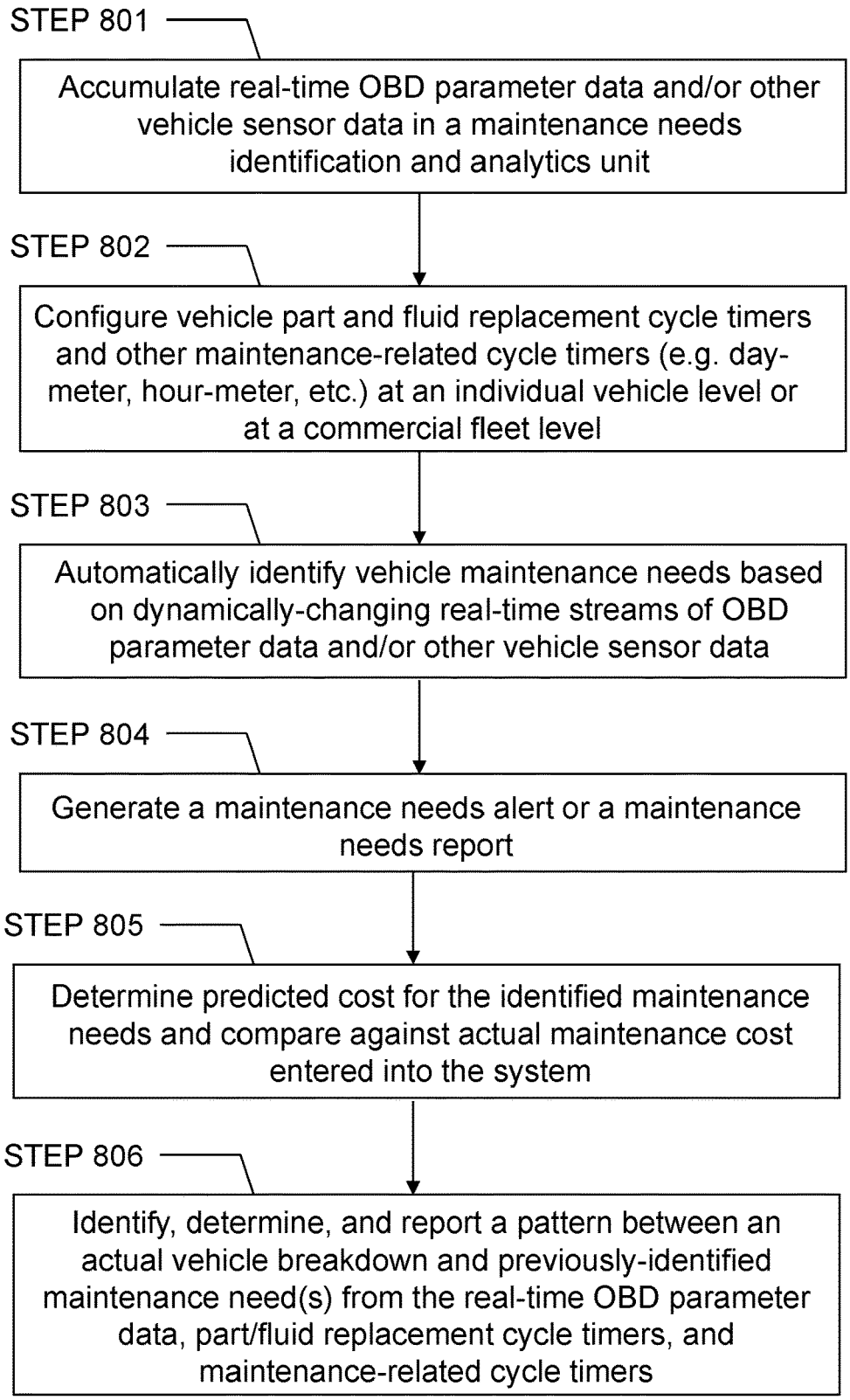
FIG. 8 shows a method of operating a real-time OBD output parameter-based commercial fleet maintenance alert system, in accordance with an embodiment of the invention.

FIG. 8 shows a method flowchart (800) for operating a real-time OBD output parameter-based commercial fleet maintenance alert system, in accordance with an embodiment of the invention. First, the real-time OBD output parameter-based commercial fleet maintenance alert system accumulates real-time OBD parameter data and/or other vehicle sensor data in a maintenance needs identification and analytics unit, as shown in STEP 801. Then, the system configures vehicle part and fluid replacement cycle timers and other maintenance-related cycle timers (e.g. day-meter, hour-meter, etc.) based on dynamically-changing maintenance guidelines gathered by artificial intelligence and/or by accepting a user adjustment feedback from a computerized user interface, as shown in STEP 802.

Subsequently, the real-time OBD output parameter-based commercial fleet maintenance alert system automatically identifies vehicle maintenance needs from the maintenance needs identification and analytics unit based on dynamically-changing real-time streams of OBD parameter data and/or other in-vehicle sensor data, as shown in STEP 803. Then, the commercial fleet maintenance needs alert module and the commercial fleet maintenance report module in the system are configured to generate a maintenance needs alert or a maintenance needs report, as shown in STEP 804.

Furthermore, the estimated and actual maintenance cost calculation module in the maintenance needs identification and analytics unit of the real-time OBD output parameter-based commercial fleet maintenance alert system determines predicted cost for the identified maintenance needs and compare against actual maintenance cost entered into the system, as shown in STEP 805. In addition, the vehicle breakdown pattern analysis module in the maintenance needs identification and analytics unit of the real-time OBD output parameter-based commercial fleet maintenance alert system is able to identify, determine, and report a pattern between an actual vehicle breakdown and previously-identified maintenance needs from the real-time OBD parameter data, part/fluid replacement cycle timers, and maintenance-related cycle timers, as shown in STEP 806.

Various embodiments of the present invention provide several key advantages to conventional methods of vehicle maintenance scheduling that merely involve simple entries of static data. One advantage of an embodiment of the present invention is providing a novel commercial fleet maintenance alert system that performs automated, real-time, and intelligent analysis of each vehicle's OBD and other sensor output parameters from a commercial fleet remote monitoring station to determine and alert each fleet vehicle's maintenance needs to a driver or a commercial fleet operator, even as the fleet vehicles are currently on-duty and away from maintenance shops and auto mechanics. The ability to monitor potential maintenance needs in a plurality of vehicles by accessing and analyzing vehicle OBD and other sensor output parameters in real time at a remote location (e.g. the commercial fleet remote monitoring station) minimizes fleet vehicle downtimes, while maximizing the accuracy and the immediacy of the maintenance-related diagnosis.

Another advantage of an embodiment of the present invention is providing a novel commercial fleet maintenance alert system that performs a machine-level pattern analysis to correlate a previously-alerted maintenance need of a particular vehicle with a subsequent breakdown of the particular vehicle in a commercial fleet to predict a future probability of similar breakdowns by other vehicles in the commercial fleet.

Furthermore, another advantage of an embodiment of the present invention is providing a novel commercial fleet maintenance alert system that estimates approximate maintenance costs for machine-identified vehicle maintenance needs and compares against actual maintenance costs incurred subsequently to improve the accuracy of the cost estimations generated by the novel commercial fleet maintenance alert system.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A commercial fleet maintenance alert system comprising:

a vehicle on-board diagnostics (OBD) device connected to an engine control unit or a vehicular control chipset of a vehicle to record, diagnose, and generate engine, vehicle dynamics, and vehicle parts operations data as streams of vehicle on-board diagnostics (OBD) data output;

a maintenance needs analytics module connected to the vehicle OBD device and analyzes the streams of vehicle OBD data output and maintenance threshold settings parameters to determine a state or municipal mandatory vehicle inspection and maintenance day-meter value that indicates remaining days as a positive number decreasing towards zero until a mandatory vehicle inspection and maintenance violation date is reached, and as a negative number if the mandatory vehicle inspection and maintenance violation date elapses without a reset authorized by a government regulatory entity, and wherein the maintenance needs analytics module also determines a vehicle maintenance need for a maintenance alert generation and to derive a quantitative correlation between the vehicle maintenance need identified by the maintenance needs analytics module and a future breakdown of the vehicle, wherein the quantitative correlation is an output of a vehicle breakdown pattern analysis module incorporated in the commercial fleet maintenance alert system;

a commercial fleet maintenance needs alert and report generation system connected to the maintenance needs analytics module, wherein the commercial fleet maintenance needs alert and report generation system comprises a commercial fleet maintenance needs alert module configured to generate a maintenance needs alert based on the vehicle maintenance need identified by the maintenance needs analytics module, and a commercial fleet maintenance report module configured to generate a report containing a maintenance requirement non-compliance item or an urgent maintenance need, wherein the maintenance needs alert and the report are transmitted to an electronic device utilized by a vehicle driver or by a system operator; and a semiconductor chip or a hardware device that contains at least one of the maintenance needs analytics module and the commercial fleet maintenance needs alert and report generation system.

2. The commercial fleet maintenance alert system of claim 1, further comprising a vehicle-specific maintenance needs identification analytics unit and a commercial fleet-level maintenance needs identification and analytics unit that incorporate an OBD and vehicle sensor output information analysis module, an individual vehicle-level maintenance threshold setting module, a commercial fleet-level maintenance global threshold setting module, a maintenance needs identification and analytics module, a vehicle part and fluid replacement cycle tracking module, a day-meter and hour-meter maintenance period regulatory requirement calculation module, an estimated and actual maintenance cost calculation module, and the vehicle breakdown pattern analysis module.

3. The commercial fleet maintenance alert system of claim 1, further comprising an OBD data transceiver unit that transmits the streams of vehicle OBD data output from the vehicle OBD device to the maintenance needs analytics module.

4. The commercial fleet maintenance alert system of claim 1, further comprising a commercial fleet maintenance database that contains vehicle maintenance records for all fleet vehicles in a commercial fleet, wherein the commercial fleet maintenance database executed on a computer server and is connected to the maintenance needs analytics module.

5. The commercial fleet maintenance alert system of claim 1, wherein the maintenance needs alert is a text message, a chat message, an email, or a phone call generated by the commercial fleet maintenance needs alert and report generation system.

6. The commercial fleet maintenance alert system of claim 1, wherein the report containing the maintenance requirement non-compliance item or the urgent maintenance need is part of a machine-generated periodic report to the vehicle driver or to the system operator on a daily, weekly, monthly, or quarterly basis.

7. The commercial fleet maintenance alert system of claim 1, further comprising a wireless and wired data network for data communication among the vehicle OBD device, the maintenance needs analytics module, the commercial fleet maintenance needs alert and report generation system, and the electronic device utilized by the vehicle driver or the system operator.

8. The commercial fleet maintenance alert system of claim 7, wherein the electronic device utilized by the vehicle driver or the system operator is a personal computer, a smart phone, a tablet computer, or another wireless communications device.

9. The commercial fleet maintenance alert system of claim 1, wherein the vehicle is a truck, a taxi, a van, or another vehicle operated and managed by a vehicle fleet company.

10. The commercial fleet maintenance alert system of claim 1, wherein the vehicle maintenance need is related to a vehicle part inspection, a vehicle part replacement, or a fluid change.

11. The commercial fleet maintenance alert system of claim 1, wherein the maintenance needs analytics module and the commercial fleet maintenance needs alert and report generation system provide a vehicle maintenance monitoring alert user interface that highlights a plurality of maintenance action items and color-codes the maintenance action items based on a level of urgency for inspecting or replacing identified parts or fluids.

12. The commercial fleet maintenance alert system of claim 1, wherein the quantitative correlation between the vehicle maintenance need identified by the maintenance needs analytics module and the future breakdown of the vehicle is expressed as an odds ratio or a risk ratio computed by the vehicle breakdown pattern analysis module.

13. The commercial fleet maintenance alert system of claim 1, wherein the streams of vehicle OBD data output contain a vehicle identification number, a current odometer reading, a total engine operating hour, and a malfunction component fault code, if any.

14. The commercial fleet maintenance alert system of claim 1, wherein the maintenance threshold settings parameters define required or desired part inspection or replacement intervals that are initiated or reset by the system operator after a previous part inspection or replacement.

* * * * *